US011476033B2

(12) United States Patent
Yoshida et al.

(10) Patent No.: US 11,476,033 B2
(45) Date of Patent: Oct. 18, 2022

(54) REACTOR PROVIDED WITH END PLATE

(71) Applicant: Fanuc Corporation, Yamanashi (JP)

(72) Inventors: Tomokazu Yoshida, Yamanashi (JP); Masatomo Shirouzu, Yamanashi (JP); Kenichi Tsukada, Yamanashi (JP)

(73) Assignee: Fanuc Corporation, Yamanashi (JP)

( * ) Notice: Subject to any disclaimer, the term of this patent is extended or adjusted under 35 U.S.C. 154(b) by 369 days.

(21) Appl. No.: 16/811,352

(22) Filed: Mar. 6, 2020

(65) Prior Publication Data

US 2020/0294704 A1 Sep. 17, 2020

(30) Foreign Application Priority Data

Mar. 14, 2019 (JP) ..... JP2019-047386

(51) Int. Cl.
*H01F 27/26* (2006.01)

(52) U.S. Cl.
CPC ..... *H01F 27/263* (2013.01)

(58) Field of Classification Search
CPC ..... H01F 27/263; H01F 27/002; H01F 27/02; H01F 17/04
See application file for complete search history.

(56) References Cited

U.S. PATENT DOCUMENTS

| | | | |
|---|---|---|---|
| 10,600,551 B2 | 3/2020 | Yoshida et al. | |
| 10,607,762 B2 | 3/2020 | Shirouzu | |
| 2017/0372828 A1* | 12/2017 | Shirouzu | H01F 27/06 |
| 2018/0183280 A1* | 6/2018 | Shirouzu | H01F 3/14 |
| 2019/0035530 A1 | 1/2019 | Yoshida et al. | |

FOREIGN PATENT DOCUMENTS

| | | | |
|---|---|---|---|
| JP | 54176817 | U | 12/1979 |
| JP | 63146439 | U | 9/1988 |
| JP | 03051936 | Y | 11/1991 |
| JP | 2005183885 | A | 7/2005 |
| JP | 2008177500 | A | 7/2008 |
| JP | 2010252539 | A | 11/2010 |
| JP | 2017098426 | A | 6/2017 |
| JP | 2017229182 | A | 12/2017 |
| JP | 2018206949 | A | 12/2018 |
| JP | 2019029449 | A | 2/2019 |

OTHER PUBLICATIONS

Japanese Decision to Grant a Patent for Japanese Application No. 2019-047386, dated Feb. 4, 2022, with translation, 5 pages.

* cited by examiner

*Primary Examiner* — Tuyen T Nguyen
(74) *Attorney, Agent, or Firm* — RatnerPrestia

(57) ABSTRACT

A reactor includes a core body, and the core body includes an outer peripheral iron core, at least three iron cores in contact with an inner surface of the outer peripheral iron core, or positioned to be coupled to the inner surface, and coils wound around the iron cores. A gap through which magnetic coupling is possible is formed between one iron core of the at least three iron cores and another iron core adjacent to the one iron core. The reactor includes an end plate attached to one end face of the core body, and the end plate includes a protruding portion that partially protrudes in a direction away from an outer circumferential surface of the core body.

9 Claims, 10 Drawing Sheets

REACTOR PROVIDED WITH END PLATE

CROSS-REFERENCE TO RELATED APPLICATIONS

This application is a new U.S. Patent Application that claims benefit of Japanese Patent Application No. 2019-047386, filed Mar. 14, 2019, the disclosure of this application is incorporated herein by reference in its entirety for all purposes.

BACKGROUND OF THE INVENTION

1. Field of the Invention

The present invention relates to a reactor provided with an end plate.

2. Description of the Related Art

A reactor includes a plurality of iron-core coils, and each iron-core coil includes an iron core and a coil wound around the iron core. Predetermined gaps are formed between the plurality of iron cores. Further, there is also a reactor in which a plurality of iron-core coils are disposed inside an outer peripheral iron core. See, for example, JP 2010-252539 A and JP 2008-177500 A.

SUMMARY OF THE INVENTION

An outer peripheral iron core of a reactor is typically polygonal or circular, and a projection or the like is not provided on an outer circumferential surface and an end face of the outer peripheral iron core, in order to obtain a desired inductance. Thus, it is not easy for a worker or robot to grip the reactor.

Also, a coil partially protrudes from the end face of the outer peripheral iron core. However, when the worker or robot grips a protruding portion of the coil, the coil may be broken. Thus, it was not easy for the worker or robot to manufacture, transport, install, or the like, the reactor.

Thus, there is a demand for a reactor that the worker or robot can easily manufacture, transport, or install.

According to a first aspect of the present disclosure, a reactor is provided that includes a core body, in which the core body includes an outer peripheral iron core, at least three iron cores in contact with an inner surface of the outer peripheral iron core or disposed to be coupled to the inner surface, and a coil wound around the iron core, a gap through which magnetic coupling is possible is formed between one iron core of the at least three iron cores and another iron core adjacent to the one iron core, an end plate attached to one end face of the core body is further included, and the end plate includes a protruding portion that partially protrudes in a direction away from an outer circumferential surface of the core body.

In the first aspect, since the end plate is provided with the protruding portion, a worker or robot can grip the protruding portion, and easily manufacture, transport, install, and the like, the reactor. Accordingly, workability and safety during manufacturing, and the like can be increased.

The objects, features and advantages of the present invention will become more apparent from the following description of the embodiments in connection with the accompanying drawings, wherein:

DETAILED DESCRIPTION

Figure 1A:
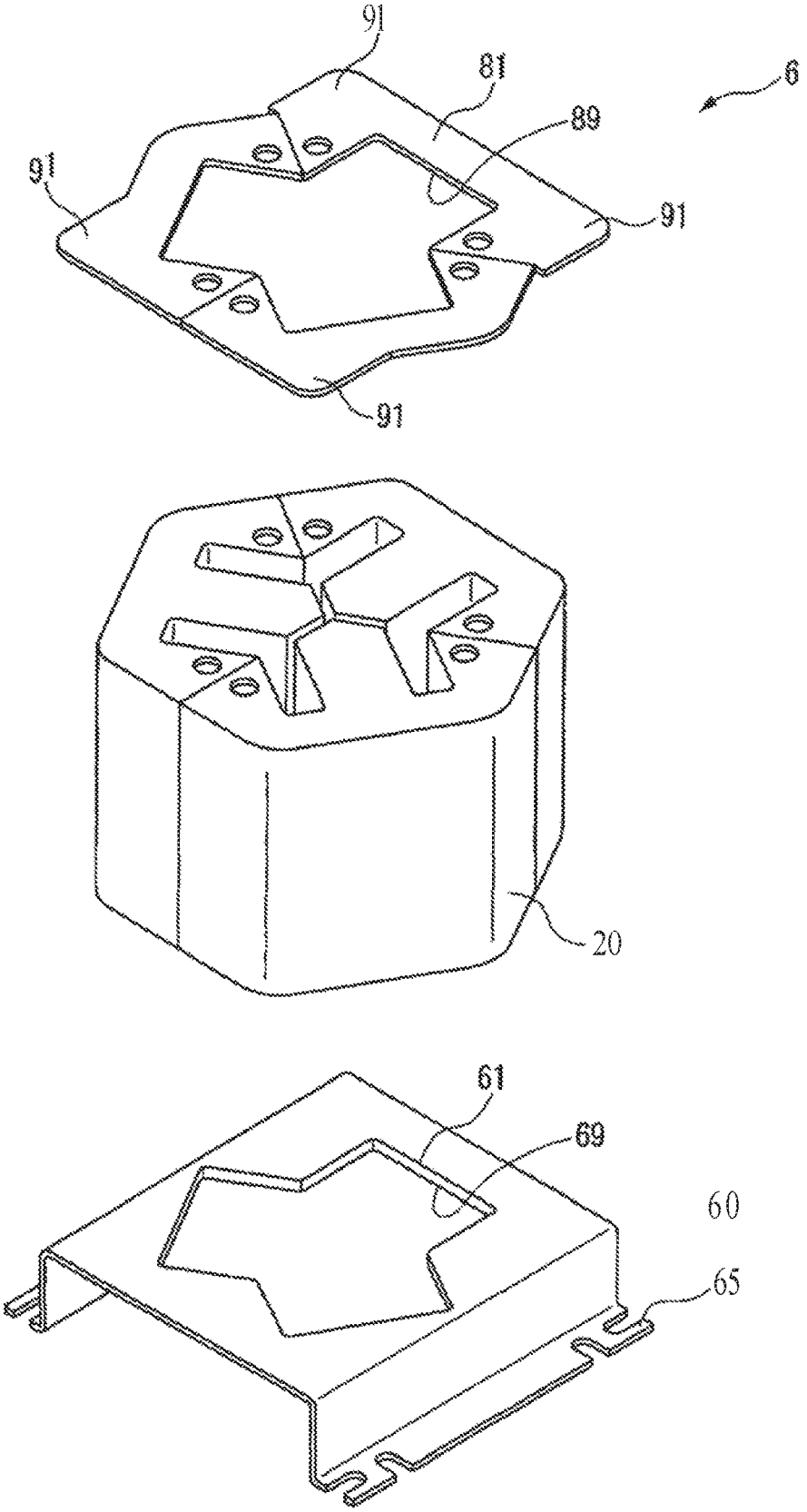
FIG. 1A is an exploded perspective view of a reactor according to a first embodiment.

Embodiments of the present invention will be described below with reference to the accompanying drawings. Throughout the drawings, corresponding components are denoted by common reference numerals.

In the following description, three-phase reactors are primarily described by way of example, but application of the present disclosure is not limited to the three-phase reactors and is widely applicable to multi-phase reactors where a constant inductance is required for each phase. Moreover, reactors according to the present disclosure are not limited to those provided on a primary side and a secondary side of an inverter in industrial robots and machine tools, but can be applied to various devices.

Figure 1B:
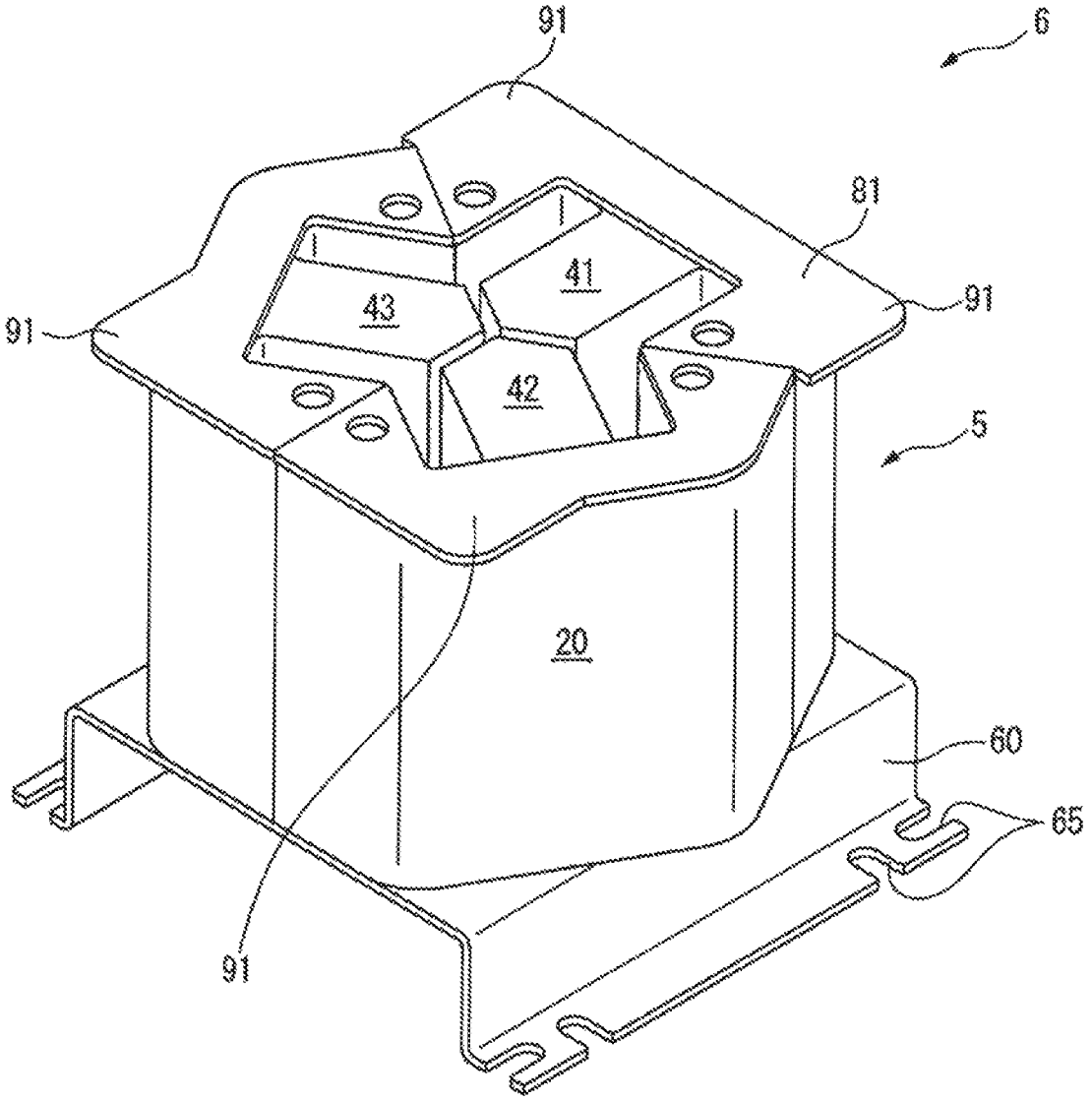
FIG. 1B is a perspective view of the reactor illustrated in FIG. 1A.

FIG. 1A is an exploded perspective view of a reactor according to a first embodiment, and FIG. 1B is a perspective view of the reactor illustrated in FIG. 1A. A reactor 6 illustrated in FIG. 1A and FIG. 1B mainly includes a core body 5, and an annular end plate 81 and a pedestal 60 that sandwich the core body 5 in an axial direction and fasten the core body 5. The end plate 81 and the pedestal 60 are in contact with an outer peripheral iron core 20 described later of the core body 5 across an entire edge portion of an end face of the outer peripheral iron core 20.

The end plate 81 and the pedestal 60 are preferably formed from a non-magnetic material, for example, aluminum, SUS, resin, or the like. An opening 69 having an outer shape suitable for mounting an end face of the core body 5 is formed in the pedestal 60. The end plate 81 has an outer shape that partially corresponds to the end face of the outer peripheral iron core 20, and an opening 89 formed in the end plate 81 has a shape that approximately corresponds to an inner circumferential surface of the outer peripheral iron core 20. The opening 69 formed in the pedestal 60 and the opening 89 formed in the end plate 81 are to be sufficiently large for coils 51 to 53 (described below) to protrude from the end face of the core body 5. Additionally, a height of the pedestal 60 is to be slightly longer than a protruding height of the coils 51 to 53 protruding from the end face of the core body 5. A notch 65 formed on a bottom face of the pedestal 60 is used to fix the reactor 6 provided on the pedestal 60 to a predetermined location.

Figure 2:
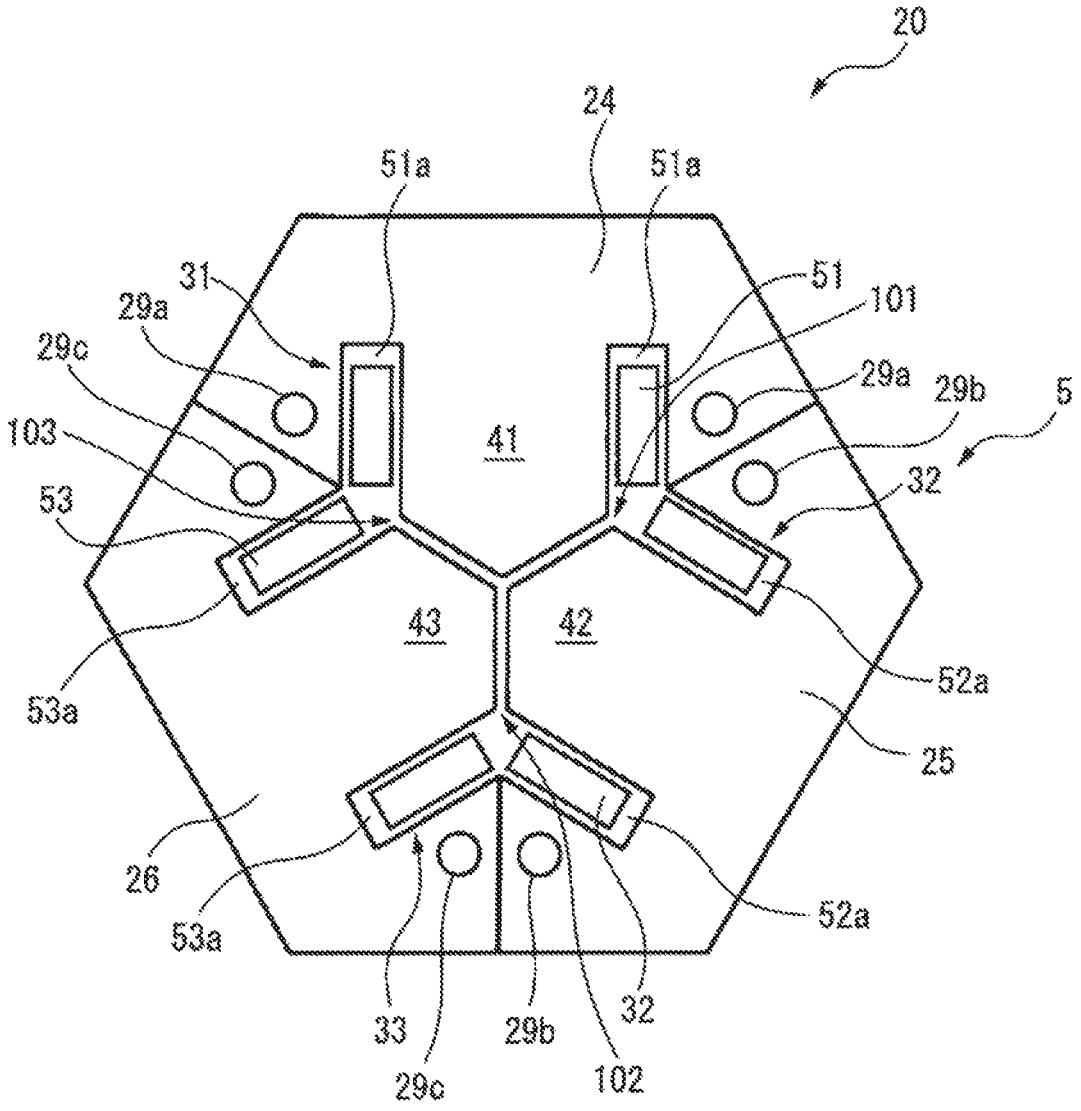
FIG. 2 is a cross-sectional view of a core body included in the reactor according to the first embodiment.

FIG. 2 is a cross-sectional view of the core body included in the reactor according to the first embodiment. As illustrated in FIG. 2, the core body 5 includes the outer peripheral iron core 20, and three iron-core coils 31 to 33 mutually and magnetically coupled to the iron-core coil 20. In FIG. 2, the iron-core coils 31 to 33 are disposed inside the outer peripheral iron core 20 having a substantially hexagonal cross section. These iron-core coils 31 to 33 are disposed at equal intervals in a circumferential direction of the core body 5. Note that, the outer peripheral iron core 20 may be a circle or other substantially regular even polygon. Also, the number of iron-core coils is preferably a multiple of three, which allows the reactor 6 to be used as a three-phase reactor.

As can be seen from the figure, the iron-core coils 31 to 33 include iron cores 41 to 43 extending only in a radial direction of the outer peripheral iron core 20, and the coils 51 to 53 wound around the iron cores, respectively. A radially outside end portion of each of the iron cores 41 to 43 is in contact with the outer peripheral iron core 20, or integrally formed with the outer peripheral iron core 20. Note that, in some figures, for simplicity, illustration of the coils 51 to 53 is omitted.

Note that, in FIG. 2, the outer peripheral iron core 20 is constituted by a plurality of, for example, three outer peripheral iron core portions 24 to 26, divided at equal intervals circumferentially. The outer peripheral iron core portions 24 to 26 are configured integrally with the iron cores 41 to 43, respectively. When the outer peripheral iron core 20 is constituted by the plurality of outer peripheral iron core portions 24 to 26 in this manner, the outer peripheral iron core 20 can be easily manufactured, even when the outer peripheral iron core 20 is large. In addition, through holes 29*a* to 29*c* are formed in the outer peripheral iron core portions 24 to 26, respectively.

Further, a radially inside end portion of each of the iron cores 41 to 43 is positioned near a center of the outer peripheral iron core 20. In the figure, the radially inside end portion of each of the iron cores 41 to 43 converges toward the center of the outer peripheral iron core 20, and has a tip angle of about 120 degrees. The radially inside end portions of the respective iron cores 41 to 43 are spaced away from each other via gaps 101 to 103 through which magnetic coupling is possible.

In other words, the radially inside end portion of the iron core 41 is spaced away from each other with the radially inside end portions of the two respective adjacent iron cores 42 and 43, via the respective gaps 101 and 102. The same applies to other iron cores 42 and 43. Note that, dimensions of the respective gaps 101 to 103 are to be equal to each other.

In this way, in the present invention, the core body 5 can be made lightweight, and easily configured, since a center part iron core that is positioned at a center part of the core body 5 is unnecessary. Furthermore, since the three iron-core coils 31 to 33 are surrounded by the outer peripheral iron core 20, magnetic fields generated from the coils 51 to 53 do not leak out of the outer peripheral iron core 20. In addition, since the gaps 101 to 103 can be provided to have any thickness and at a low cost, it is advantageous in design compared to a reactor in the related art.

Furthermore, in the core body 5 of the present invention, there is less difference in a magnetic path length between phases, compared to a reactor with structure in the related art. Thus, in the present invention, it is also possible to reduce inductance unbalance due to the difference in magnetic path length.

Figure 3:
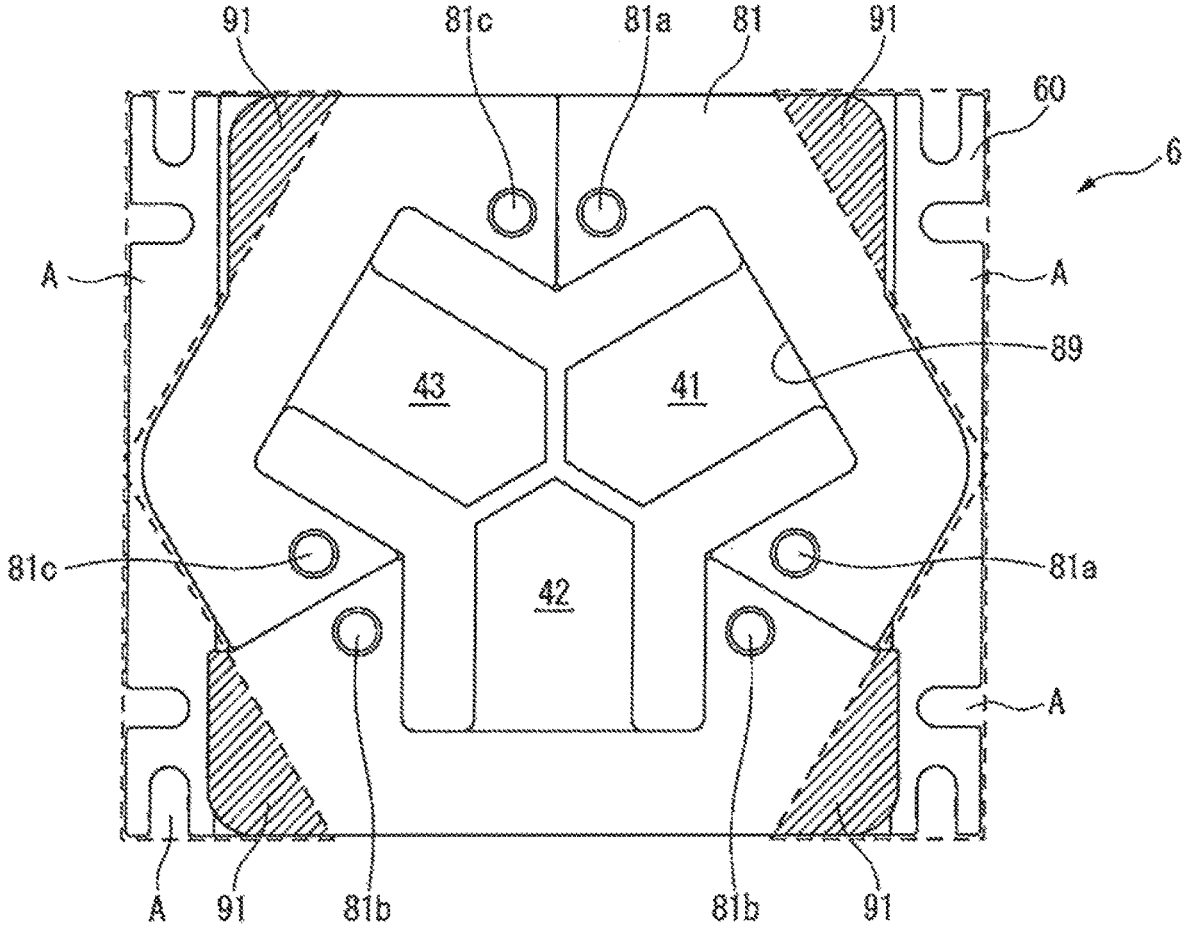
FIG. 3 is a top plan view of the reactor according to the first embodiment.

FIG. 3 is a top plan view of the reactor according to the first embodiment. As can be seen from FIG. 1A, FIG. 1B, and FIG. 3, the end plate 81 includes a protruding portion 91 that partially protrudes in a direction spaced away from an outer circumferential surface of the core body 5. It can also be rephrased that the protruding portion 91 extends radially outward with respect to a central axis line of the core body 5.

In addition, through holes 81*a* to 81*c* are formed in the end plate 81 in correspondence with the through holes 29*a* to 29*c* of the outer peripheral iron core 20, respectively. After the end plate 81 is assembled on the core body 5 around which the coils 51 to 53 are wound, screws or bolts (not illustrated) are inserted into the through holes 81*a* to 81*c* of the end plate 81, and the through holes 29*a* to 29*c* of the outer peripheral iron core 20 and tightened. Note that, similar through holes may be formed in the pedestal 60. The same applies to embodiments described below.

The protruding portion 91 protrudes corresponding to at least one side of a substantially regular even polygon, for example, a substantially hexagonal shape. The protruding portion 91 is gripped by the worker or robot (not illustrated), so that the reactor 6 can be easily manufactured, transported, installed, or the like. Accordingly, workability and safety during manufacturing, and the like can be increased.

As illustrated in FIG. 3, when the outer peripheral iron core 20 is a substantially hexagonal shape, four of the protruding portions 91 protrude corresponding to respective four sides of the substantially hexagonal shape. In FIG. 3, two sides adjacent to one side on which the protruding portion 91 is provided include a side on which the protruding portion 91 is provided and a side on which the protruding portion 91 is not provided. When a plurality of, for example, four the protruding portions 91 are provided in this manner, particularly when the robot grips the protruding portion 91, the reactor 6 can be manufactured, transported, installed, or the like more stably.

Also, as can be seen from FIG. 1A, a footprint of the pedestal 60 is a rectangular shape, which is a circumscribed rectangular shape circumscribing an outer circumference of the outer peripheral iron core 20. Accordingly, the footprint of the pedestal 60 is different from a shape of the outer circumference of the core body 5 such as, for example, a substantially regular even polygon or a circular shape. In such cases, at least one the protruding portion 91 preferably protrudes within a range of the footprint of the pedestal 60. In other words, the protruding portion 91 preferably extends within a substantially triangular range A corresponding to a region from an outer circumferential surface of the outer peripheral iron core 20 to an outer edge of the pedestal 60.

In such cases, the protruding portion 91 only protrudes up to the outer edge of the pedestal at most. Thus, a footprint of the reactor 6 is smaller than or equal to the footprint of the pedestal 60, so an increasing in size of the reactor 6 can be avoided.

Figure 4:
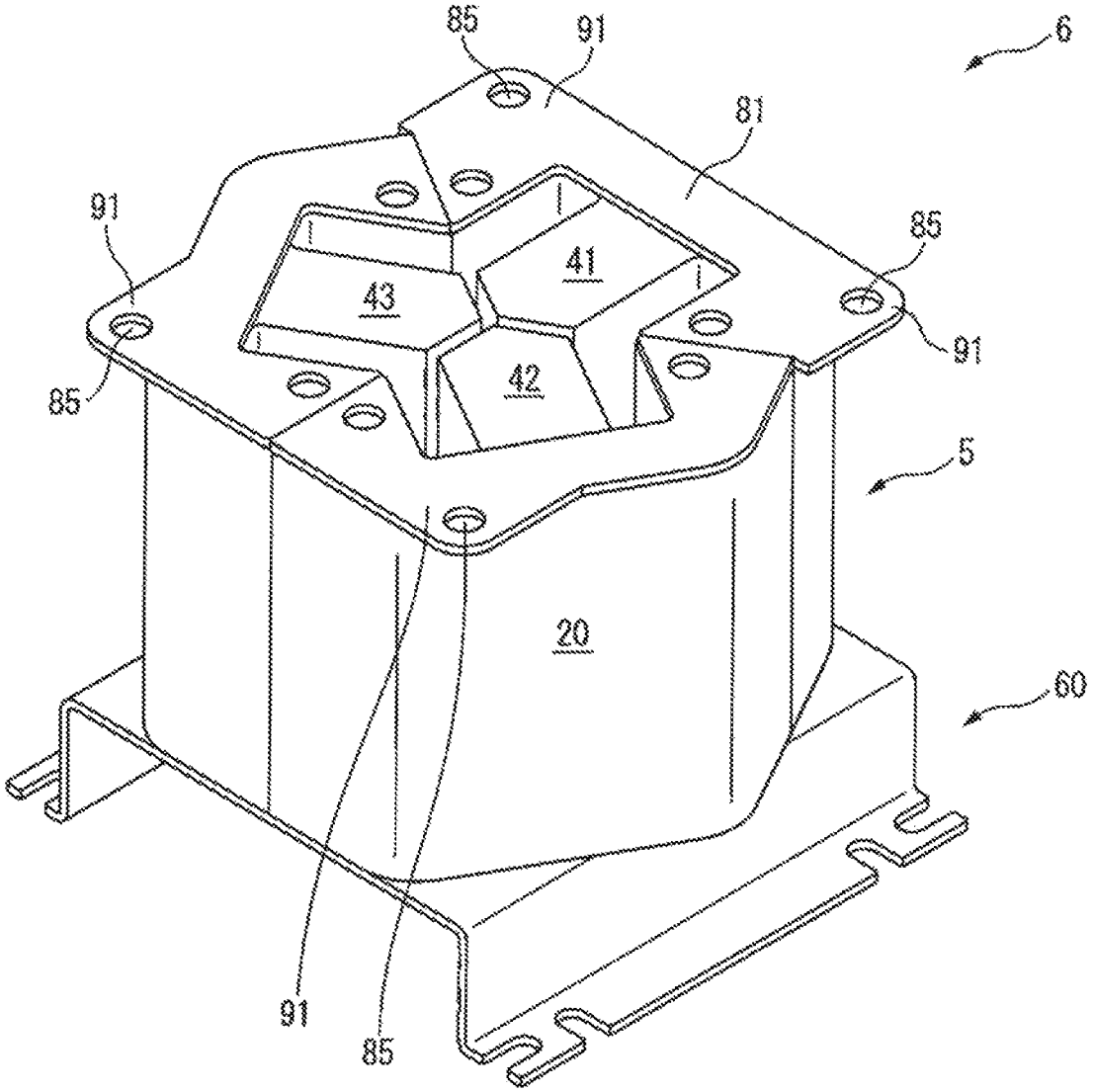
FIG. 4 is a perspective view of a reactor in another embodiment.

Additionally, FIG. 4 is a perspective view of a reactor according to another embodiment. In FIG. 4, an opening 85 is formed in each of the protruding portions 91 of the end plate 81. In this case, the reactor 6 can be suspended by passing a wire or the like through the opening 85. Thus, convenience when manufacturing, transporting, installing, and the like of the reactor 6 can be improved.

Figure 5:
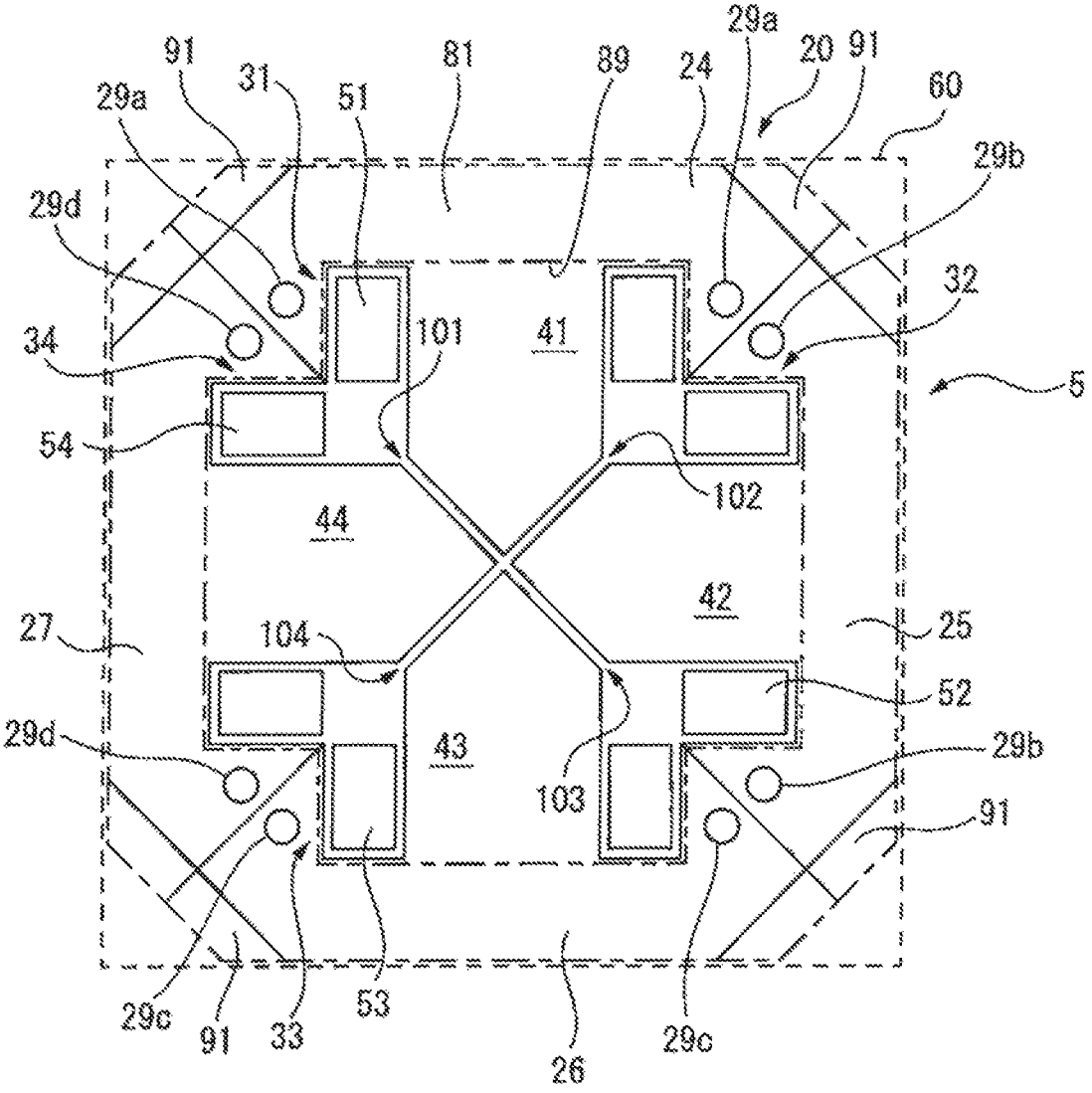
FIG. 5 is a cross-sectional view of a core body included in a reactor according to a second embodiment.

FIG. 5 is a cross-sectional view of a core body included in a reactor according to a second embodiment. The core body 5 illustrated in FIG. 5 includes the outer peripheral iron core 20 having a substantially octagonal cross section, and four iron-core coils, i.e., the iron-core coils 31 to 33 and an iron-core coil 34, similar to those described above, disposed inward the iron-core coil 20. These iron-core coils 31 to 34 are disposed at equal intervals in a circumferential direction of the core body 5. Furthermore, the number of iron cores is preferably an even number of four or more, which allows the reactor provided with the core body 5 to be used as a single-phase reactor.

As can be seen from the figure, the outer peripheral iron core 20 is constituted by four portions, i.e., the outer peripheral iron core portions 24 to 26, and an outer peripheral iron core portion 27 that are circumferentially divided. The iron-core coils 31 to 34 include the iron cores 41 to 43 and an iron core 44 extending only in a radial direction, and coils 51 to 53 and a coil 54 wound around the iron cores, respectively. Radially outside end portions of the respective iron cores 41 to 44 are formed integrally with the respective outer peripheral iron core portions 24 to 27. In addition, the through holes 29*a* to 29*c* and a through hole 29*d* similar to those described above are formed in the respective outer peripheral iron core portions 24 to 27. Note that, the number of iron cores 41 to 44, and the number of outer peripheral iron core portions 24 to 27 need not necessarily match. The same applies to the core body 5 illustrated in FIG. 2.

Further, a radially inside end portion of each of the iron cores 41 to 44 is positioned near a center of the outer peripheral iron core 20. In FIG. 5, the radially inside end portion of each of the iron cores 41 to 44 converges toward the center of the outer peripheral iron core 20, and has a tip angle of about 90 degrees. Additionally, the radially inside end portions of the iron cores 41 to 44 are spaced away from each other via the gaps 101 to 103 and a gap 104 through which magnetic coupling is possible, respectively.

A dashed line illustrated in FIG. 5 approximately corresponds to a footprint of the pedestal 60 in the second embodiment. That is, the pedestal 60 is a circumscribed rectangular shape that circumscribes an outer circumference of the outer peripheral iron core 20. Furthermore, dot-dash lines illustrated in FIG. 5 correspond to the end plate 81 and the opening 89 in the second embodiment, respectively.

As illustrated in FIG. 5, when the outer peripheral iron core 20 is a substantially octagonal shape, four of the protruding portions 91 protrude corresponding to respective four sides of the substantially hexagonal shape. In FIG. 5, the protruding portion 91 is not provided on two sides adjacent to one side on which the protruding portion 91 is provided. The protruding portion 91 extends within the substantially triangular range A corresponding to a region from an outer circumferential surface of the outer peripheral iron core 20 to an outer edge of the pedestal 60. Thus, it is clear that similar effects to those described above are also obtained in the embodiment illustrated in FIG. 5.

Figure 6:
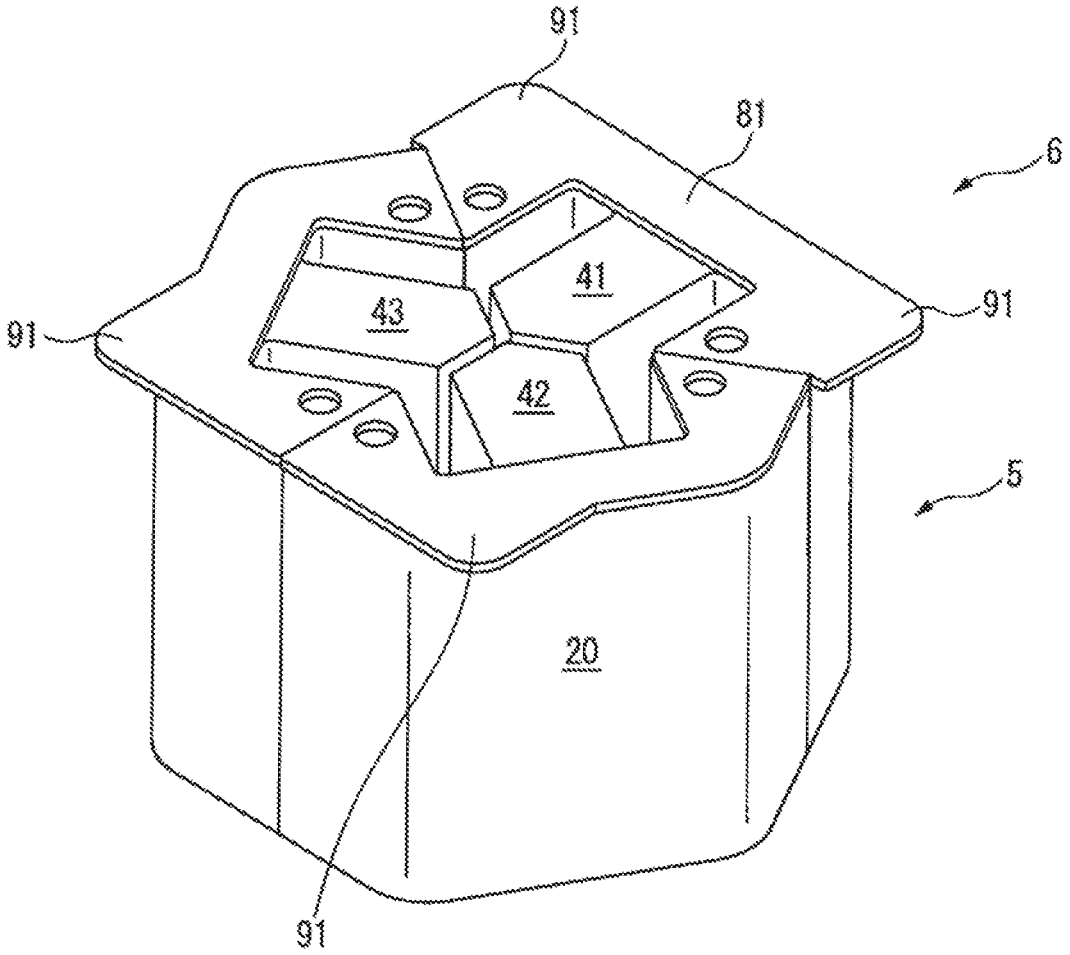
FIG. 6 is a perspective view of a reactor according to a third embodiment.

Further, FIG. 6 is a perspective view of a reactor according to a third embodiment. The reactor 6 illustrated in FIG. 6 is similar to the reactor 6 illustrated in FIG. 1B, except that the pedestal 60 is removed, and thus detailed descriptions thereof will be omitted.

Figure 7:
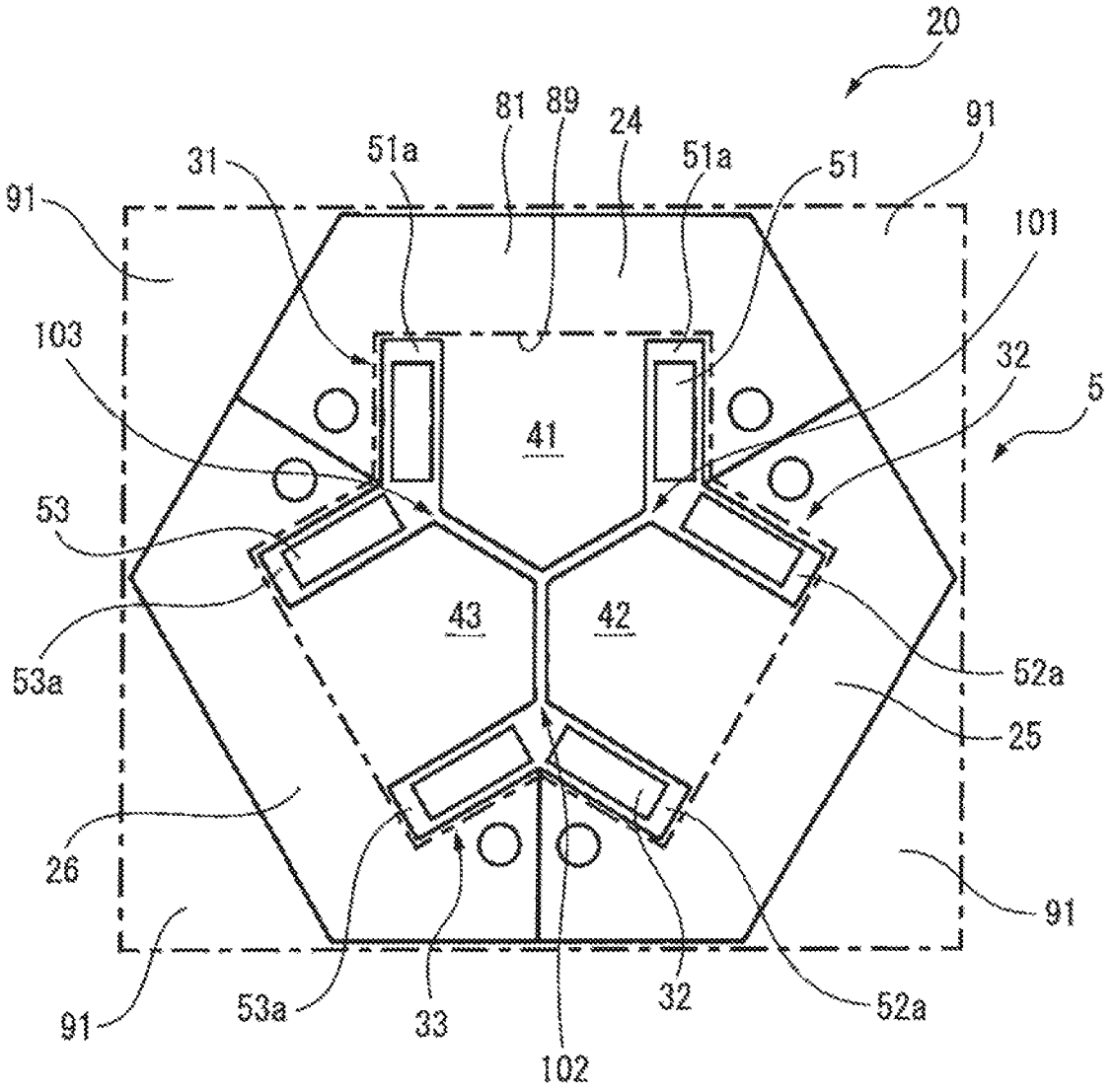
FIG. 7 is a cross-sectional view of a core body included in the reactor according to the third embodiment.

FIG. 7 is a cross-sectional view of a core body included in the reactor according to the third embodiment. The core body 5 is similar to that described with reference to FIG. 2, and thus detailed descriptions thereof will be omitted. Dashed lines illustrated in FIG. 7 illustrate the end plate 81 and the opening 89, respectively. Accordingly, the end plate 81 illustrated in FIG. 7 is provided with four of the protruding portions 91 that are substantially triangular shapes. As can be seen from FIG. 7, when the outer peripheral iron core 20 is a substantially hexagonal shape, the protruding portion 91 is not provided corresponding to a pair of opposing two sides, and the protruding portions 91 are provided corresponding to remaining four sides.

Figure 8:
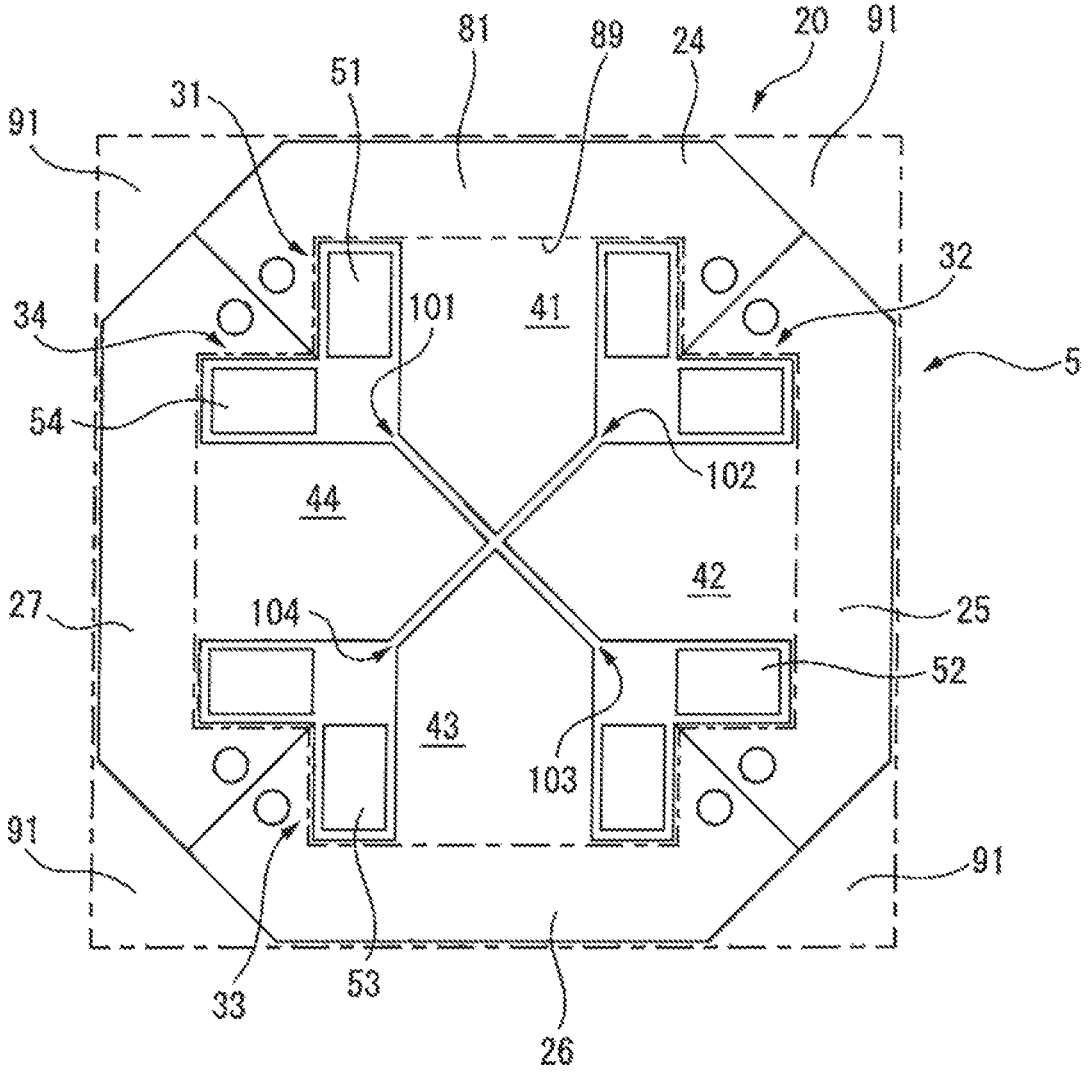
FIG. 8 is a cross-sectional view of a core body included in a reactor according to a fourth embodiment.

Similarly, FIG. 8 is a cross-sectional view of a core body included in a reactor according to a fourth embodiment. The core body 5 is similar to that described with reference to FIG. 5, and thus detailed descriptions thereof will be omitted. Dashed lines illustrated in FIG. 8 illustrate the end plate 81 and the opening 89, respectively. Accordingly, the end plate 81 illustrated in FIG. 8 is provided with four of the protruding portions 91 that are substantially triangular shapes. As can be seen from FIG. 8, when the outer peripheral iron core 20 is a substantially octagonal shape, the protruding portion 91 is not provided corresponding to two pairs of opposing two sides, and the protruding portions 91 are provided corresponding to remaining four sides.

Thus, when the outer peripheral iron core 20 is a substantially regular even polygon, the protruding portion 91 is not provided corresponding to at least a pair of opposing two sides, and the protruding portions 91 are provided corresponding to remaining sides. In such a case, a side of a certain reactor from which a protruding portion does not protrude can be brought into contact with a side of another reactor from which a protruding portion does not protrude. Accordingly, in the case of FIG. 7, a plurality of the reactors can be apposed adjacent to each other in a vertical direction of a plane of paper. Similarly, in the case of FIG. 8, a plurality of the reactors can be apposed adjacent to each other in a left-right direction of a plane of paper. Accordingly, a work space and the like can be reduced.

Figure 9:
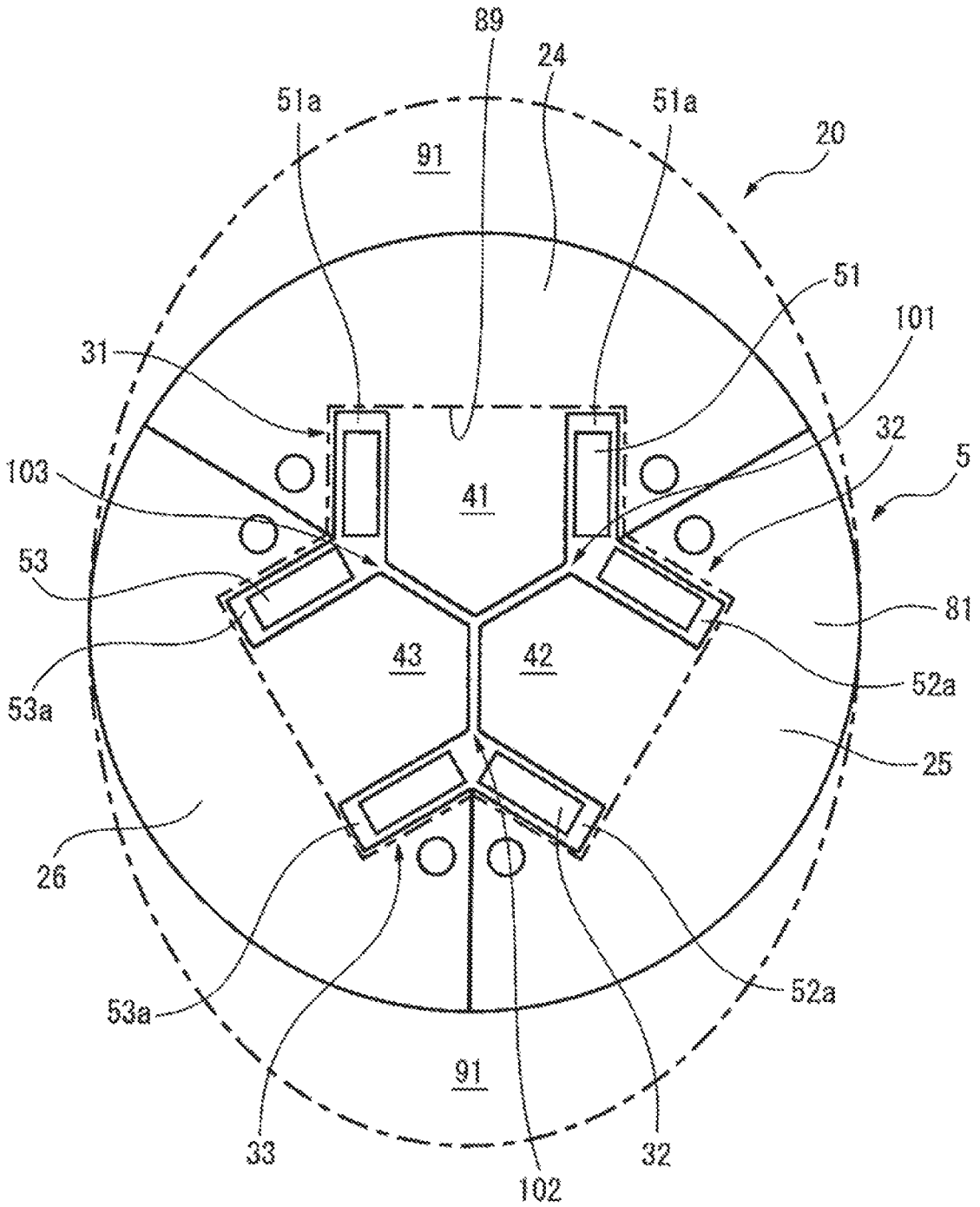
FIG. 9 is a cross-sectional view of a core body included in a reactor according to a fifth embodiment.

Additionally, FIG. 9 is a cross-sectional view of a core body included in a reactor according to a fifth embodiment. In FIG. 9, the core body 5 is illustrated that includes the outer peripheral iron core 20 having a circular cross section. Other than that, the core body 5 is similar to the core body 5 illustrated in FIG. 2, thus detailed descriptions thereof will be omitted. Dashed lines illustrated in FIG. 9 illustrate the end plate 81 that is substantially elliptical, and the opening 89 similar to that described above, respectively. Thus, the end plate 81 illustrated in FIG. 9 is provided with two of the substantially C-shaped protruding portions 91. As can be seen from FIG. 9, when the outer peripheral iron core 20 is a substantially circular shape, the protruding portion 91 is not provided corresponding to at least a pair of diametrically opposed arc portions in a circumference, and the protruding portions 91 are provided on remaining arc portions. In this case, a plurality of the reactors can be apposed adjacent to each other in a left-right direction of a plane of paper, and thus, a work space and the like can be reduced.

Aspects of the Disclosure

According to a first aspect, a reactor is provided that includes a core body, in which the core body includes an outer peripheral iron core, at least three iron cores in contact with an inner surface of the outer peripheral iron core or disposed to be coupled to the inner surface, and a coil wound around the iron core, a gap through which magnetic coupling is possible is formed between one iron core of the at least three iron cores and another iron core adjacent to the one iron core, an end plate attached to one end face of the core body is further included, and the end plate includes a protruding portion that partially protrudes in a direction away from an outer circumferential surface of the core body.

According to a second aspect, in the first aspect, a pedestal fastened to another end face of the core body is further included, and the protruding portion extends within a range corresponding to a region from an outer circumferential surface of the outer peripheral iron core to an outer edge of the pedestal.

According to a third aspect, in the first or second aspect, an opening is formed in the protruding portion.

According to a fourth aspect, in any one of the first to third aspects, a cross section of the outer peripheral iron core is a regular even polygon, and the protruding portion protrudes corresponding to at least one side of the regular even polygon.

According to a fifth aspect, in any one of the first to third aspects, a cross section of the outer peripheral iron core is a regular even polygon, and the protruding portion does not protrude corresponding to at least a pair of opposing two sides of the regular even polygon, and protrudes corresponding to a remaining side of the regular even polygon.

According to a sixth aspect, in any one of the first to third aspects, a cross-section of the outer peripheral iron core is a circle, and the protruding portion protrudes corresponding to at least a portion of a circumference of the circle.

According to a seventh aspect, in any one of the first to third aspects, a cross-section of the outer peripheral iron core is a circle, and the protruding portion does not protrude corresponding to at least a pair of diametrically opposed arc portions of a circumference of the circle, and protrudes corresponding to a remaining arc portion of the circumference.

According to an eighth aspect, in any one of the first to seventh aspects, the number of the at least three iron cores is a multiple of three.

According to a ninth aspect, in any one of the first to seventh aspects, the number of the at least three iron cores is an even number of four or more.

Effects of Aspects

In the first aspect, since the end plate is provided with the protruding portion, a worker or robot can grip the protruding portion, and easily manufacture, transport, install, and the like, the reactor. Accordingly, workability and safety during manufacturing, and the like can be increased.

In the second aspect, the protruding portion extends within the range corresponding to the region from the outer circumferential surface of the outer peripheral iron core to the outer edge of the pedestal. That is, the protruding portion only protrudes up to the outer edge of the pedestal at most. Thus, an increase in size of the reactor can be avoided.

In the third aspect, convenience of manufacturing, transporting, installing, and the like of the reactor can be improved by passing a wire through the opening.

In the fourth aspect, the protruding portions can be easily gripped by the worker or robot, making it possible to further increase workability and safety during manufacturing and the like.

In the fifth aspect, a side of one reactor from which the protruding portion does not protrude can be brought into contact with a side of another reactor from which the protruding portion does not protrude, thus a plurality of the reactors can be apposed adjacent to each other.

In the sixth aspect, the protruding portions can be easily gripped by the worker or robot, making it possible to further increase the workability and safety during manufacturing and the like.

In the seventh aspect, a portion of one reactor from which the protruding portion does not protrude can be brought into contact with a portion of another reactor from which the protruding portion does not protrude, thus a plurality of the reactors can be apposed adjacent to each other.

In the eighth aspect, the reactor can be used as a three-phase reactor.

In the ninth aspect, the reactor can be used as single-phase reactors.

While the invention has been described with reference to specific embodiments, it will be understood, by those skilled in the art, that various changes or modifications may be made thereto without departing from the scope of the following claims.

The invention claimed is:

1. A reactor, comprising:

a core body, wherein the core body includes an outer peripheral iron core, at least three iron cores, each having a radially outside end portion in contact with an inner surface of the outer peripheral iron core or disposed to be coupled to the inner surface, and a coil wound around the iron core;

a gap through which magnetic coupling is possible is formed between one iron core of the at least three iron cores and another iron core adjacent to the one iron core; and an end plate attached to one end face of the core body, wherein the end plate includes at least one protruding portion that partially protrudes in a direction spaced away from an outer circumferential surface of the core body, and wherein the protruding portion of the end plate corresponds to a profile of a respective side of the outer peripheral iron core.

2. The reactor of claim 1, further comprising a pedestal fastened to another end face of the core body, wherein the protruding portion extends within a range corresponding to a region from an outer circumferential surface of the outer peripheral iron core to an outer edge of the pedestal.

3. The reactor of claim 1, wherein the protruding portion is formed with an opening.

4. The reactor of claim 1, wherein a cross section of the outer peripheral iron core is a regular even polygon, and the protruding portion protrudes corresponding to at least one side of the regular even polygon.

5. The reactor of claim 1, wherein a cross section of the outer peripheral iron core is a regular even polygon, and the protruding portion does not protrude corresponding to at least a pair of opposing two sides of the regular even polygon, and protrudes corresponding to a remaining side of the regular even polygon.

6. The reactor of claim 1, wherein a cross-section of the outer peripheral iron core is a circle, and the protruding portion protrudes corresponding to at least a portion of a circumference of the circle.

7. The reactor of claim 1, wherein a cross-section of the outer peripheral iron core is a circle, and the protruding portion does not protrude corresponding to at least a pair of diametrically opposed arc portions of a circumference of the circle, and protrudes corresponding to a remaining arc portion of the circumference.

8. The reactor of claim 1, wherein a number of the at least three iron cores is a multiple of three.

9. The reactor of claim 1, wherein a number of the at least three iron cores is an even number of four or more.

* * * * *